US006902213B2

(12) United States Patent
Lee

(10) Patent No.: US 6,902,213 B2
(45) Date of Patent: Jun. 7, 2005

(54) TAIL GATE LOCKING SYSTEM

(75) Inventor: Kyung Choong Lee, Gwangmyoung (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 10/295,452

(22) Filed: Nov. 15, 2002

(65) Prior Publication Data

US 2004/0094966 A1 May 20, 2004

(51) Int. Cl.[7] ..... E05C 3/06
(52) U.S. Cl. ..... 292/216; 292/DIG. 29
(58) Field of Search ..... 292/216, 201, 292/DIG. 29, DIG. 62; 70/238

(56) References Cited

U.S. PATENT DOCUMENTS 2,926,943 A * 3/1960 Leslie ..... 292/53
3,146,021 A * 8/1964 Ericson ..... 296/106
3,645,043 A * 2/1972 Velavicius et al. ..... 49/370
4,093,289 A * 6/1978 Inabayashi et al. ..... 292/336.3
4,157,844 A * 6/1979 Sarosy et al. ..... 292/48
4,505,500 A * 3/1985 Utsumi et al. ..... 292/48
4,867,495 A * 9/1989 Nakamura ..... 292/336.3
5,035,449 A * 7/1991 Shiratori et al. ..... 292/48
5,117,665 A * 6/1992 Swan et al. ..... 70/264
5,295,374 A * 3/1994 Bender et al. ..... 70/208
5,947,536 A * 9/1999 Mizuki et al. ..... 292/201
6,017,067 A * 1/2000 Yoneyama et al. ..... 292/216
6,343,494 B2 * 2/2002 Roos et al. ..... 70/264

* cited by examiner

*Primary Examiner*—Gary Estremsky
(74) *Attorney, Agent, or Firm*—Morgan Lewis & Bockius LLP

(57) ABSTRACT

The invention relates to a coupling structure between a lock and a latch in a vehicular tail gate locking system. The coupling structure of the invention comprises a key lever rotated depending on displacement of a first rod coupled to the lock and a remote lever rotated depending on rotation of the key lever to shift the position of the second rod. A control latch is further provided which allows the second rod to maintain its position as the lock is further rotated by any angle while the lock is in a locked position so that the further rotational force of the lock lever caused by a user is not transmitted to the latch.

5 Claims, 5 Drawing Sheets

TAIL GATE LOCKING SYSTEM

FIELD OF THE INVENTION

The present invention relates generally to a tail gate locking system, and more particularly, to a rotation-absorbing device capable of absorbing rotational force of a lock lever to prevent the rotational force of the lock lever from being transmitted to a tail gate latch in a locking system.

BACKGROUND OF THE INVENTION

In a coupling structure between a tail gate lock and a tail gate latch, which are components of a tail gate locking system, the lock and latch are directly connected via either one or two rods and an intermediate crank lever. As a lock lever connected to the rod(s) is rotated right or left through a designated angle, the tail gate lock is locked or unlocked by the tail gate latch via the rod(s) connected therebetween.

However, where conventional coupling structures provide further function in addition to the function of controlling the locking/unlocking between the lock and latch, e.g., where it is necessary to increase the rotation angle of the lock lever by a further angle in order to control a window latch, such coupling structures may have potential problems in operation. For example, as the lock lever is rotated further, beyond the point necessary for operation of the latch, the rod(s) and the crank lever, if any, transmit the further rotational force to the latch without absorbing the further unnecessary rotational force.

SUMMARY OF THE INVENTION

In a coupling structure according to an embodiment of the present invention, a control latch is mounted to be capable of absorbing the further rotational force of the lock lever for accomplishing an additional function. Thus, both a tail gate latch and a window latch can be controlled in common with one lock without further mounting any additional device for controlling the window latch and the like.

In a further alternative embodiment of the present invention, a tail gate locking system comprises a lock mechanism including a lock lever. A window rod is linked to the lock lever for actuating a window latch. A first latch rod is linked to the lock lever opposite the window rod. A control latch is linked to the first latch rod opposite the lock lever, and a second latch rod is linked to the control latch for actuating a door latch. Preferably, the control latch comprises a base member and two linkage members. The first linkage member is pivotably mounted on the base member at a pivot point and defines an opening with peripheral camming surfaces. The first linkage member is also connected to the first latch rod. The second linkage member is pivotably mounted on the base member and includes a pin cooperating with the camming surface of the first linkage member. The second linkage member is connected to the second latch rod.

In a preferred embodiment, the camming surfaces of the first linkage member are disposed around the edges of the opening. These camming surfaces include a first camming surface corresponding to an arc defined by a first radius from the pivot point, a second camming surface corresponding to an arc defined by a second, longer radius from the pivot point, and at least a third camming surface corresponding to an arc defined by a third radius, longer than the first and second radii, extending from the pivot point.

BRIEF DESCRIPTION OF THE DRAWINGS

The features and other advantages of the present invention will be more clearly understood from the following detailed description taken in conjunction with the accompanying drawings, in which.

BACKGROUND OF THE INVENTION

The following detailed description will present a preferred embodiment of the invention in reference to the accompanying drawings.

Figure 1:
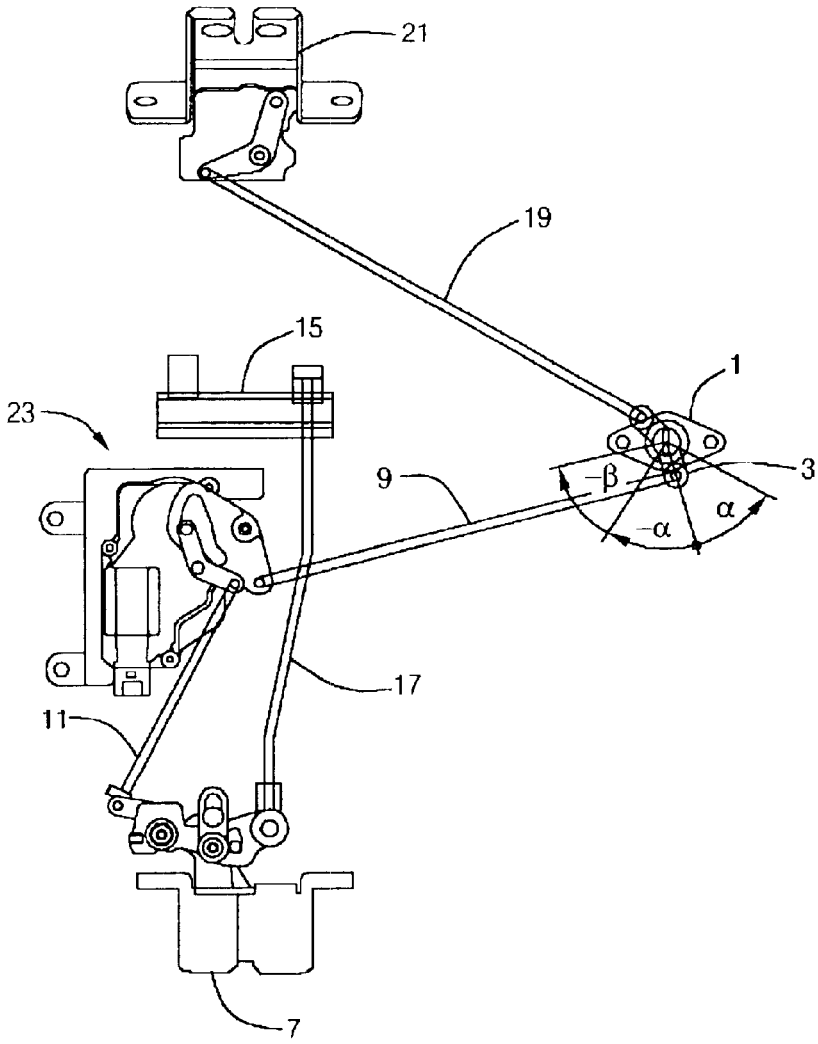
FIG. 1 is a schematic diagram of a coupling structure according to an embodiment of the present invention.

As shown in FIG. 1, a coupling structure between a lock lever and a latch section of a tail gate 7 includes a window latch 21 connected to the lock section 1 via a window rod 19 in addition to conventional components. The lock lever 3 is connected to one end of the first rod 9 and the latch section 7 is connected to one end of the second rod 11. A control latch 23 is connected to the opposite ends of the first rod 9 and the second rod 11 so that rotational force of the lock lever 3 caused by the window latch 21 is not transmitted to the latch section 7.

Figure 2:
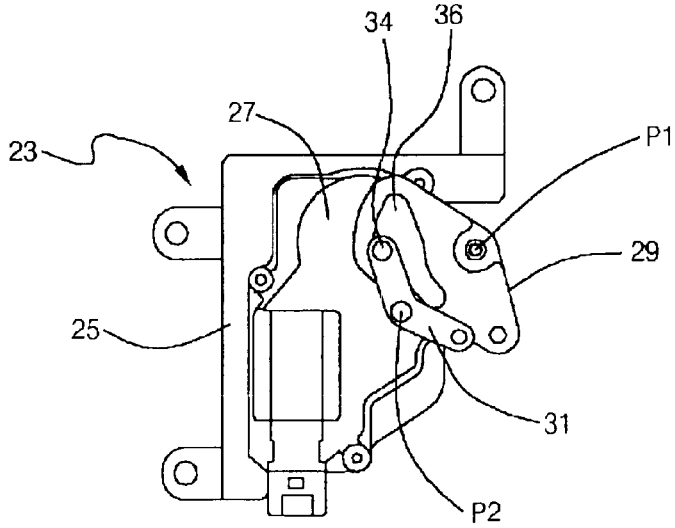
FIG. 2 is a schematic diagram illustrating a control latch according to an embodiment of the invention.

As shown in FIG. 2, the control latch 23 includes a base 25, an actuator 27, a key lever 29 and a remote lever 31. The base 25 is mounted on the tail gate, and serves to fix other components. The key lever 29 is rotatable about an axis P1 and restricted in movement by the first rod 9 connected thereto. Key lever 29 controls axial rotation of the remote lever 31, coupled to key lever 29 so as to restrain the position of the remote lever 31. In a preferred embodiment, pin 34 extending from remote lever 31 acts as a cam along the periphery of opening 36 in key lever 29.

Figure 3A:
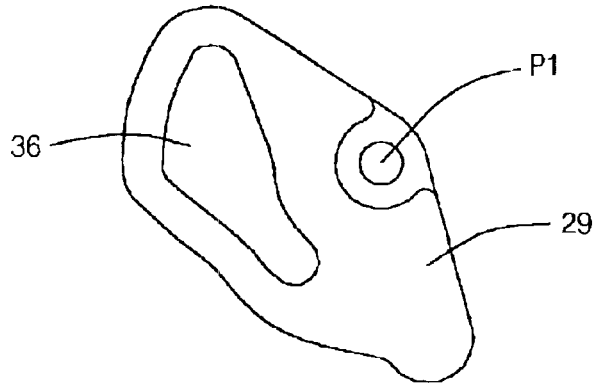
FIG. 3A is a diagram of a key lever according to one embodiment of the invention.
Figure 3B:
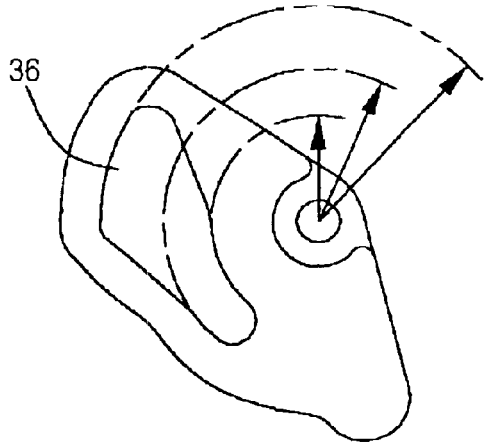
FIG. 3B is a diagram illustrating an opening in the key lever of FIG. 3A.

FIG. 3A is a plan view of the key lever 29 separated from the control latch 23 for the purpose of illustrating the configuration of an upper portion of the key lever 29. FIG. 3B illustrates the configuration of an opening in the key lever 29. As shown in FIG. 3B, the periphery of the opening partially corresponds to arcs of concentric circles described, respectively, from the axis P1 as their common center or origin.

Figure 4:
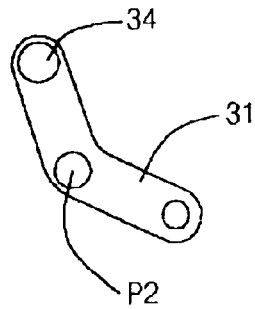
FIG. 4 is a diagram of a remote lever according to an embodiment of the invention.

As shown in FIG. 4, the remote lever 31, rotatable about an axis P2, is axially rotated and restricted in movement owing to axial rotation of the key lever 29 so as to restrain the position of the second rod 11 coupled thereto. The control latch 23 shifts the second rod 11 for a given distance when the lock lever 3 is rotated right or left by an angle $\alpha$. Control latch 23, however, has no effect on the position of the second rod 11 when the lock lever 3 is further rotated by any angle $\beta$.

Figure 5A:
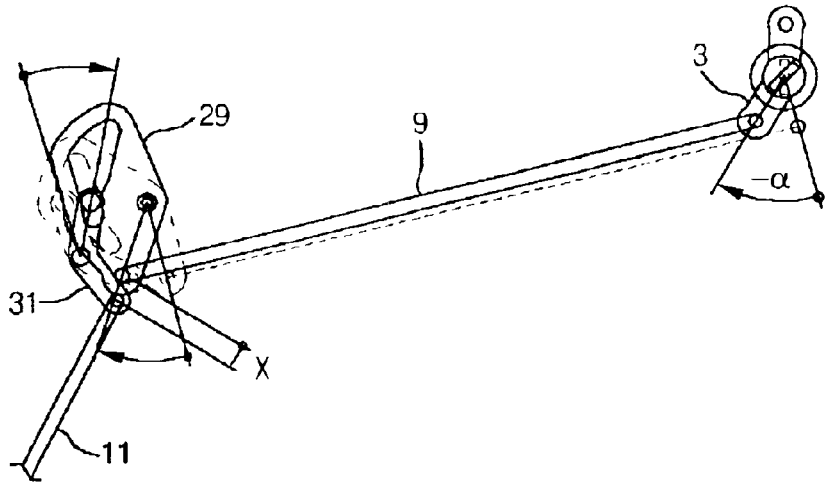
FIGS. 5A to 5E are schematic diagrams illustrating aspects of the operational position of the control latch depending on locking, unlocking and further rotational force of a lock.

As shown in FIG. 5A, the relative position between the key lever 29 and the remote lever 31 changes when the lock is moved to a locked position from an unlocked position.

Displacing the lock lever 3 to the left by an angle α from the unlocked position shifts the position of the second rod 11 with a distance X.

Figure 5B:
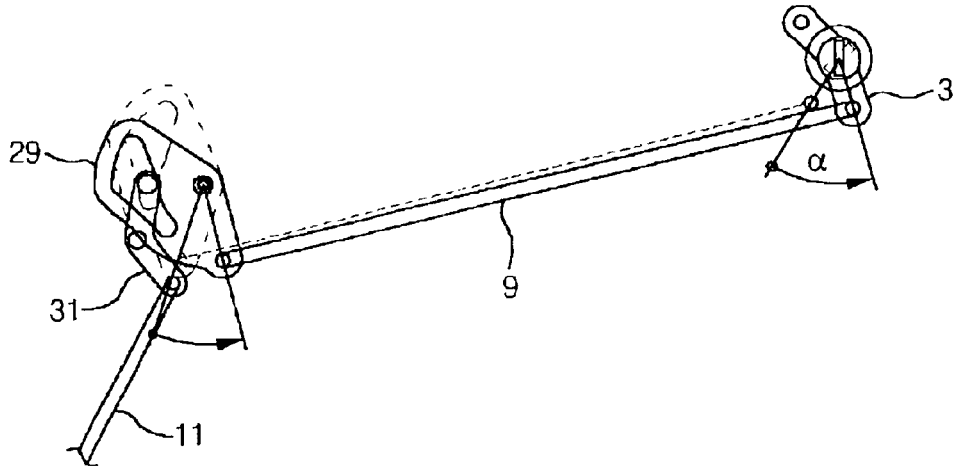

FIG. 5B shows the relative position between the key lever 29 and the remote lever 31 when a key is removed in the locked position. In this case, even though the lock lever 3 is displaced to the right by the angle α toward its original position, the second rod 11 maintains its position, shifted with the distance X, without any change in position.

Figure 5C:
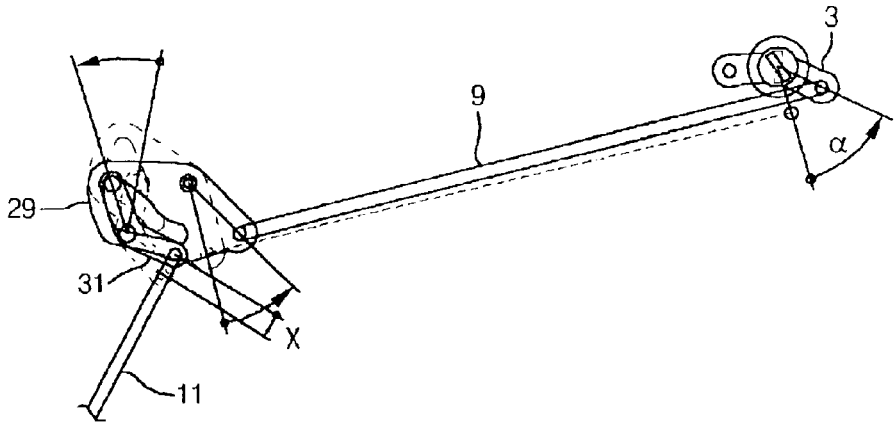

FIG. 5C shows the relative position between the key lever 29 and the remote lever 31 when the tail gate is unlocked from the locked position. Displacing the lock lever 3 to the right by the angle α from the locked position shifts the position of the second rod 11 by the distance X so as to return the second rod 11 into its original position.

Figure 5D:
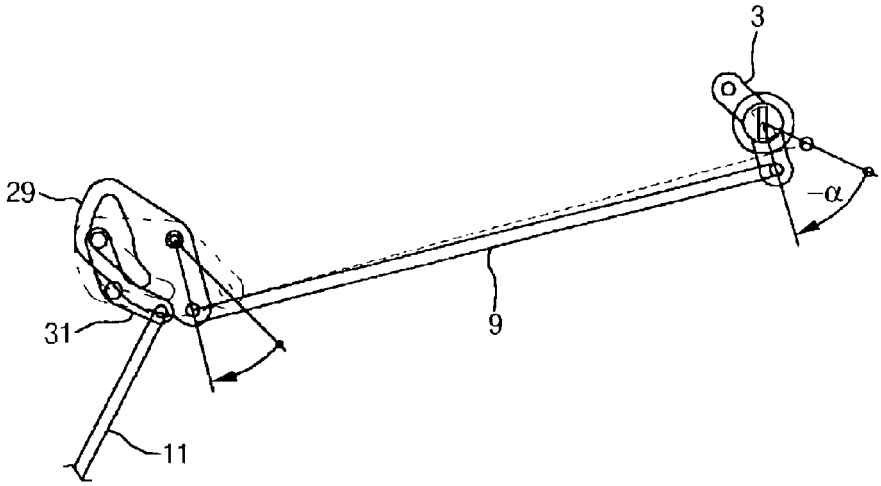

FIG. 5D shows the relative position between the key lever 29 and the remote lever 31 if the key is removed in an opened position. In this case, even though the lock lever 3 is displaced to the left by the angle α, the second rod 11 maintains its position.

Figure 5E:
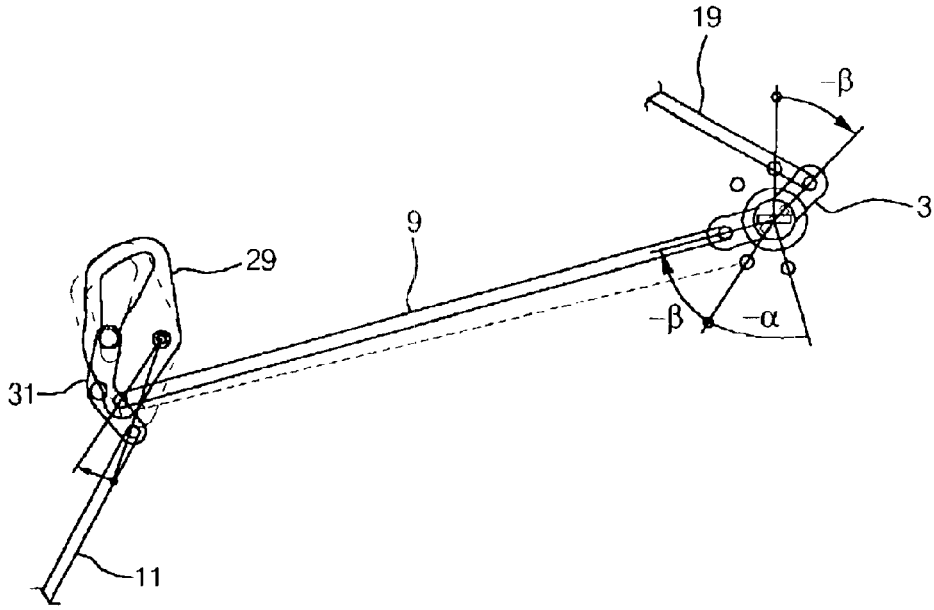

FIG. 5E shows the relative position between the key lever 29 and the remote lever 31 when a window is opened in the locked position. In this case, the lock lever 3 is displaced to the left by the angle β, whereas the second rod 11 maintains its position. As a result, further rotational force along the angle β does not have an effect on the position of the second rod 11.

According to the coupling structure having the above construction and operation, both the tail gate latch and the window latch can be controlled in common with one lock. Further, since it is unnecessary to mount any additional device for controlling the window latch, components can be reduced in number so as to save cost as well as simplify assembly process.

While the present invention has been shown and described in connection with the preferred embodiment, it is intended that the present invention is not limited to the foregoing embodiment but those skilled in the art can make various modifications and variations without departing from the principle of the invention as defined in the appended claims.

What is claimed is:

1. A coupling structure adapted to cooperate between a tail gate lock and a tail gate latch in a vehicular tail gate locking system wherein the lock may be rotated beyond a first angle defining a locked position, said system comprising:

a first rod having first and second ends, the first end of the first rod being connected to the tail gate lock;

a second rod having first and second ends, with the first end of the second rod connected to the tail gate latch; and a control latch for allowing the second rod to maintain its position as the lock is rotated beyond the first angle, the second end of the first rod and the second end of the second rod being connected to the control latch, wherein the control latch includes:

a base mounted on the tail gate;

a key lever supported on the base and coupled to the first rod for rotation depending on displacement of the first rod; and a remote lever supported on the base for rotation depending on rotation of the key lever to shift the position of the second rod connected to the remote lever, whereby the second rod is displaced by a proper distance as the lock is locked from an unlocked position, the second rod maintains its position as a key is removed in the locked position of the lock, the second rod is reversely displaced by the proper distance to its original position as the lock is unlocked from the locked position, the second rod maintains its position as the key is removed in the unlocked position of the lock, and the second rod maintains its position when the lock is further rotated in the locked position.

2. A tail gate locking system, comprising:

a lock mechanism including a lock lever having first and second sides;

a window rod having a first end and a second end, the first end of the window rod linked to the first side of the lock lever and the second end of the window rod linked to a window latch;

a first latch rod having a first end and a second end, the first end of the first latch rod linked to the second side of the lock lever and the second end of the first latch rod linked to a control latch linked to the first latch rod; and a second latch rod having a first end a second end, the first end of the second latch rod linked to the control latch and the second end of the second latch rod linked to a door latch;

wherein said control latch comprises:

a base member;

a first linkage member pivotably mounted on the base member at a pivot point and defining an opening with peripheral camming surfaces, said first linkage member being connected to the first latch rod; and a second linkage member pivotably mounted on the base member and including a pin cooperating with said camming surfaces, said second linkage member being connected to the second latch rod; and wherein said camming surfaces comprise:

a first camming surface corresponding to an arc defined by a first radius from the pivot point;

a second camming surface corresponding to an arc defined by a second, longer radius from the pivot point; and at least a third camming surface corresponding to an arc defined by a third radius, longer than the first and second radii, extending from the pivot point.

3. A tail gate locking system, comprising:

a lock mechanism including a lock lever having first and second sides;

a window rod having a first end and a second end, the first end of the window rod linked to the first side of the lock lever and the second end of the window rod linked to a window latch;

a first latch rod having a first end and a second end, the first end of the first latch rod linked to the second side of the lock lever and the second end of the first latch rod linked to a control latch; and a second latch rod having a first end a second end, the first end of the second latch rod linked to the control latch and the second end of the second latch rod linked to a door latch;

wherein the lock lever may be rotated beyond a first angle defining a locked position, while the control latch allows the second latch rod to maintain its position as the lock lever is rotated beyond the first angle; and wherein said control latch comprises:

a base member;

a first linkage member pivotably mounted on the base member at a pivot point and defining an opening with peripheral camming surfaces, said first linkage member being connected to the first latch rod; and a second linkage member pivotably mounted on the base member and including a pin cooperating with said camming surfaces, said second linkage member being connected to the second latch rod; and wherein said camming surfaces comprise:

a first camming surface corresponding to an arc defined by a first radius from the pivot point;

a second camming surface corresponding to an arc defined by a second, longer radius from the pivot point; and at least a third camming surface corresponding to an arc defined by a third radius, longer than the first and second radii, extending from the pivot point.

4. A tail gate locking system, comprising:

a lock mechanism including a lock lever having first and second sides;

a window rod having a first end and a second end, the first end of the window rod linked to the first side of the lock lever and the second end of the window rod linked to a window latch;

a first latch rod having a first end and a second end, the first end of the first latch rod linked to the second side of the lock lever and the second end of the first latch rod linked to a control latch; and a second latch rod having a first end a second end, the first end of the second latch rod linked to the control latch and the second end of the second latch rod linked to a door latch;

wherein the lock lever may be rotated beyond a first angle defining a locked position, while the control latch allows the second latch rod to maintain its position as the lock lever is rotated beyond the first angle; and wherein said control latch comprises:

a base member;

a first linkage member pivotably mounted on the base member at a pivot point and defining an opening with peripheral camming surfaces, said first linkage member being connected to the first latch rod; and a second linkage member pivotably mounted on the base member and including a pin cooperating with said camming surfaces, said second linkage member being connected to the second latch rod; and wherein the control latch includes:

a base mounted on the tail gate;

a key lever supported on the base and coupled to the first rod for rotation depending on displacement of the first rod; and a remote lever supported on the base for rotation depending on rotation of the key lever to shift the position of the second rod connected to the remote lever, whereby the second rod is displaced by a proper distance as the lock is locked from an unlocked position, the second rod maintains its position as a key is removed in the locked position of the lock, the second rod is reversely displaced by the proper distance to its original position as the lock is unlocked from the locked position, the second rod maintains its position as the key is removed in the unlocked position of the lock, and the second rod maintains its position when the lock is further rotated in the locked position.

5. A tail gate locking system, comprising:

a lock mechanism including a lock lever;

a window rod linked to the lock lever for actuating a window latch;

a first latch rod linked to the lock lever opposite the window rod;

a control latch linked to the first latch rod opposite the lock lever; and a second latch rod linked to the control latch for actuating a door latch;

wherein the control latch comprises:

a base member;

a first linkage member pivotably mounted on the base member at a pivot point and defining an opening with peripheral camming surfaces, said first linkage member being connected to the first latch rod; and a second linkage member pivotably mounted on the base member and including a pin cooperating with said camming surfaces, said linkage member being connected to the second latch;

wherein the camming surfaces comprise:

a first canning surface corresponding to an arc defined by a first radius from the first pivot point;

a second camming surface corresponding to an arc defined by a second, longer radius from the pivot point; and at least a third canning surface corresponding to an arc defined by a third radius, longer than the first and second radii, extending from the pivot point.

* * * * *